US008561516B2

(12) United States Patent
Martinez et al.

(10) Patent No.: US 8,561,516 B2
(45) Date of Patent: Oct. 22, 2013

(54) SYSTEM AND METHOD FOR NON-LETHAL VEHICLE RESTRAINT

(75) Inventors: Martin A. Martinez, Phoenix, AZ (US); Patrick J. Barnhill, Chandler, AZ (US); Steven A. Floyd, Petaluma, CA (US)

(73) Assignee: Engineering Science Analysis Corporation, Tempe, AZ (US)

( * ) Notice: Subject to any disclaimer, the term of this patent is extended or adjusted under 35 U.S.C. 154(b) by 968 days.

(21) Appl. No.: 11/708,234

(22) Filed: Feb. 20, 2007

(65) Prior Publication Data

US 2007/0264079 A1 Nov. 15, 2007

Related U.S. Application Data

(60) Provisional application No. 60/775,495, filed on Feb. 21, 2006.

(51) Int. Cl.
*E01F 13/12* (2006.01)
*F41F 7/00* (2006.01)

(52) U.S. Cl.
USPC ..... 89/1.34; 404/6

(58) Field of Classification Search
USPC ..... 102/401–403, 406, 409, 502–504; 89/1.11, 1.34, 50; 188/8, 4 R; 404/6
See application file for complete search history.

(56) References Cited

U.S. PATENT DOCUMENTS

| | | | | |
|---|---|---|---|---|
| 1,217,415 | A * | 2/1917 | Colomyjczuk | 89/1.34 |
| 1,488,182 | A * | 3/1924 | Whelton | 102/504 |
| 1,536,164 | A * | 5/1925 | Tainton | 102/504 |
| 2,569,977 | A * | 10/1951 | Dickinson | 441/9 |
| 3,085,510 | A * | 4/1963 | Campbell | 102/456 |
| 3,746,285 | A * | 7/1973 | Mango | 244/98 |
| 4,253,132 | A * | 2/1981 | Cover | 361/232 |
| 4,327,644 | A * | 5/1982 | Stancil | 102/504 |
| 4,712,479 | A * | 12/1987 | Babel | 102/427 |
| 5,345,874 | A * | 9/1994 | Lemonnier et al. | 102/424 |
| 5,396,830 | A * | 3/1995 | Kornblith et al. | 89/1.34 |
| 5,750,918 | A * | 5/1998 | Mangolds et al. | 102/502 |
| 5,762,443 | A | 6/1998 | Gelfand et al. | |
| 5,811,713 | A | 9/1998 | Gudgel | |
| 5,936,183 | A * | 8/1999 | McNulty, Sr. | 89/1.11 |
| 6,269,726 | B1 * | 8/2001 | McNulty, Sr. | 89/1.11 |
| 6,312,188 | B1 | 11/2001 | Ousterhout et al. | |
| 6,312,189 | B1 | 11/2001 | Marphetia | |
| 6,381,894 | B1 * | 5/2002 | Murphy | 42/77 |

(Continued)

OTHER PUBLICATIONS

National Institute of Justice, "Department of Defense Non-lethal Weapons and Equipment Review: A Research Guide for Civil Law Enforcement and Corrections," Oct. 2004 NCJ205293.

Greg Lucas, "Bay Area's New Efforts in the War on Terror Coast Guard Weapon: Hightech net to keep boats from off-limits areas," San Francisco Chronicle Article, Aug. 10, 2005.

(Continued)

*Primary Examiner* — Bret Hayes
*Assistant Examiner* — Reginald Tillman, Jr.
(74) *Attorney, Agent, or Firm* — Perkins Coie LLP

(57) ABSTRACT

An undercarriage immobilization device and method of restraining a vehicle uses tendrils and straps to engage the vehicle. The tendrils and straps will wrap around moving parts of the vehicle and restrain the moving parts to eventually incapacitate the vehicle. The undercarriage immobilization device includes a housing that contains tendrils that are launched from the housing by a propellant or compressed gas. The tendrils may be attached to the straps carried by the undercarriage immobilization device. Straps may be pulled off the housing leaving the housing near the point of deployment.

19 Claims, 4 Drawing Sheets

(56) References Cited

U.S. PATENT DOCUMENTS

| | | | | |
|---|---|---|---|---|
| 6,553,912 | B2 * | 4/2003 | Wygant | 102/498 |
| 6,854,374 | B1 * | 2/2005 | Breazeale | 86/50 |
| 7,201,531 | B2 | 4/2007 | Shackelford et al. | |
| 7,210,875 | B1 | 5/2007 | Christle et al. | |
| 7,220,076 | B2 | 5/2007 | Boll | |
| 7,275,889 | B1 | 10/2007 | McGill | |
| 7,314,007 | B2 * | 1/2008 | Su | 102/502 |
| 7,398,617 | B2 * | 7/2008 | Mattox | 43/58 |
| 7,640,839 | B2 * | 1/2010 | McNulty, Jr. | 89/1.11 |
| 2005/0016372 | A1 * | 1/2005 | Kilvert | 89/1.34 |
| 2006/0140715 | A1 | 6/2006 | Lyddon et al. | |
| 2007/0266883 | A1 | 11/2007 | Law et al. | |

OTHER PUBLICATIONS

MIL-HDBK 5 "Military Handbook Metallic Materials and Elements for Aerospace Vehicle Structures," United States DOD, Dec. 1, 1998.

MIL-HDBK 17 "Military Handbook Composite Materials Handbook," United States DOD, Dec. 12, 2002.

Honeywell Spectra Technical Bulletin, HON-PF-PS10.

Steven H. Scott, "Sticky Foam as a Less-Than-Lethal Technology," Sandia National Laboratory, US DOE Contract No. DE-AC04-96AL8500, CIRCA 1994.

T.D. Goolby and K.J. Padilla, "Sticky Foam Restraining Effectiveness Human Subject Tests for the Less-Than-Lethal Foam Project," Sandia Report, Jul. 8, 1994 UNCI.

* cited by examiner

SYSTEM AND METHOD FOR NON-LETHAL VEHICLE RESTRAINT

CROSS REFERENCE TO RELATED APPLICATION

This application is entitled to and claims the benefit of Provisional Patent Application Ser. No. 60/775,495 filed Feb. 21, 2006 and hereby incorporates such application in its entirety.

STATEMENT REGARDING FEDERALLY SPONSORED RESEARCH

Some elements of this invention were developed under Department of Homeland Security SBIR Contract NBCH060024.

BACKGROUND OF THE INVENTION

1. Field of the Invention

This invention is related to a system, apparatus and method for the non-lethal restraint of a vehicle through the use of an entanglement device that will entangle such vehicle. The non-lethal entanglement device incorporates a plurality of tendrils, filaments, tentacles or straps, or a combination there of, that are propelled from a housing by compressed gas or by pressure generated by a gas generator of the type commonly used in air bag deployment apparatus. Filaments that are launched from the device may be attached to frangible balls carrying adhesive substances or barbed capture elements that will adhere or stick to a target surface. The filaments are designed to assist in entangling a target vehicle and restrain the entangled target.

2. Description of Related Art

Devices for stopping a fleeing vehicle include barriers, tire spike strips, caltrops, snares and electrical system disabling devices. The well-known spike strip, with spikes projecting upwardly from a base structure, usually an elongated structure, either a rolled up device or an accordion type device, is designed to be placed on a road in anticipation that a fleeing target vehicle will be driven over the spike strip. Once tire contact is made with the spike strip it will cause deflation of vehicle tires, and eventually cause the vehicle to stop due to the vehicle being difficult to control on flat tires. Barriers, such as concrete barricades, can be effective but to set them up is time consuming and barriers are not particularly portable. Barriers are normally used only in static, non-portable placements. Caltrops are small pyramid-like devices with four projections at about one hundred nine degrees offset to each other. When a caltrop is deployed it will have one of the projections, typically a spike, pointing vertically upward. A vehicle will have to drive directly over a caltrop so as to puncture a tire. Snares, such as a net that is stretched across a road, can also be effective in stopping a vehicle but such snares are time consuming to set up, are generally bulky and heavy and need to be anchored securely to restrain a moving vehicle.

It is also known that there are vehicle immobilization devices that depend on an electrical charge to disable the vehicle. These devices may work with vehicles that have electronic ignition, on-board engine and component control computers, microchip controlled systems, and other electrical control components that can be destroyed or made inoperative through the application of a voltage surge or other high energy electrical pulse or charge provided to a vulnerable electrical systems. Such electrical based-disabling devices may have limited or no effect on vehicles with shielded electrical systems or on vehicles that are not electronically dependent to operate.

Regardless of the type of vehicle stopping device used it is enlightening to realize that the energy needed to stop a fast moving vehicle is significant. Kinetic energy attained by a moving vehicle is on the order of one-half of the mass of the vehicle times the velocity squared. Thus a large truck, such as the well known Humvee (High Mobility Multipurpose Wheeled Vehicle ("HMMWM"), can exhibit more than ten times the kinetic energy of a small passenger car. Thus it is important to realize that a large amount of energy is needed to stop a moving vehicle and that any immobilization device will need to be effective against an array of vehicles to be capable of stopping heavy as well as light vehicles. In this invention the undercarriage immobilization device described herein is not intended to go "head-to-head" with the fleeing vehicle, but is designed to use motion of the vehicle components to assist in the restraint or capture of a target vehicle and thus render the vehicle immobile or significantly slowed to the point of being easily overtaken by law enforcement personnel.

To reduce the complexity and length of the Detailed Specification, and to fully establish the state of the art in certain areas of technology, Applicants herein expressly incorporate by reference material identified in the following publications:

National Institute of Justice, "Department of Defense Non-lethal Weapons and Equipment Review: A Research Guide for Civil Law Enforcement and Corrections," October 2004, NCJ-205293.

Greg Lucas, "Bay Area's New Efforts in the War on Terror Coast Guard Weapon: High-tech net to keep boats from off-limits areas," San Francisco Chronicle Article, Aug. 10, 2005. (Available on the Internet.).

MIL-HDBK 5 "Military Handbook Metallic Materials and Elements for Aerospace Vehicle Structures," United States DOD, Dec. 1, 1998.

MIL-HDBK 17 "Military Handbook Composite Materials Handbook," United States DOD, Dec. 12, 2002.

Honeywell Spectra Technical Bulletin, HON-PF-PS10, (Available on the Internet).

Steven H. Scott, "Sticky Foam as a Less-Than-Lethal Technology," Sandia National Laboratory, US DOE Contract No DE-AC04-96AL8500, CIRCA 1994.

T. D. Goolby and K. J. Padilla, "Sticky Foam Restraining Effectiveness Human Subject Tests for the Less-Than-Lethal Foam Project," Sandia Report, Jul. 8, 1994 UNCI (Available on the Internet).

The applicants believe that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, an apparatus and a method for restraining targeted land vehicles.

The undercarriage immobilization device presented here is a small, compact, lightweight and inexpensive undercarriage immobilization device that can be readily deployed by ground-based personnel from a moving vehicle or from aircraft. The undercarriage immobilization device is capable of slowing and eventually stopping a vehicle by ensnaring the rotating components on the underside of the vehicle and rendering these components immobile. Once positioned in the expected path of a target vehicle the undercarriage immobilization device is prepared for a two-event activation cycle by safely arming the device remotely either through a proximity sensor, a RF remote activator, or through a hard-wired controller. After arming the device the first event is activated to deploy a plurality of inflatable primary straps and at this point the undercarriage immobilization device is ready for interaction with a target vehicle.

In one embodiment of the invention the activation hardware and the ensnaring elements are carried on or in a truncated cylindrical housing. This housing presents a small, light, self-contained entanglement device. In an example embodiment, the undercarriage immobilization device has a general disc shape having thickness or height that is a fraction of the diameter of the disc. To suggest, but not to be construed as a limitation, the size of the housing may be about a foot in diameter and about four inches thick. Somewhat on the order of a device that can fit in a standard briefcase. These are not fixed or required sizes and the inventors contemplate that the height to diameter can be any reasonable ratio where the undercarriage immobilization device remains compact, small, light and easy to carry and deploy. In one embodiment the undercarriage immobilization device will have a single pressure manifold and a pressure-generating device, such as compressed gas or a gas generator as is commonly used in automotive airbag technology, connected to the manifold. In other embodiments more than one manifold and more than one pressure generating device, or any combination thereof, may be incorporated into the device. A plurality of barrels will be provided in the housing. These projectile containing barrels are connected to a pressure manifold such that when the manifold is pressurized firing mechanisms for launching the projectiles housed in the barrels will be subjected to the pressure generated by the gas generator. A projectile, in one embodiment a projectile, and in another embodiment, a frangible ball containing an adhesive, and in yet another embodiment a barbed capture element, is mounted proximate to and may be attached to a fiber or tendril wound on a spool of the projectile or the housing. A second or trailing end of the tendril portion of the projectile may be attached to a strap that will be deployed from the housing once the tendril has connected to a targeted vehicle. In one embodiment of the invention the tendril will be wound on a spool and the projectile will unwind the tendril from the spool as the projectile is in flight toward a target. In another embodiment, the spool is located on the projectile.

In a simplified embodiment of the vehicle restraint device, the operation of the simple embodiment will proceed as follows. The housing is placed in the path of a vehicle and when the vehicle is driven over the housing a detonator in the housing will activate the gas generator releasing significant pressure into a pressure manifold the housing. This pressure will launch the projectile, in one embodiment, frangible balls and associated tendrils. It is expected that the frangible balls, which may contain an adhesive or one or more barbs, or both, will engage a rotating component of the moving vehicle, perhaps a tire or a rotating element of the vehicle. Once the tendrils are engaged with the vehicle, the tendril, made of ultra strong material such as Kevlar brand high strength polymer fiber, or Spectra brand fiber, the tendrils will ensnare rotating or moving parts of the vehicle and draw a strong strap into contact with rotating parts on the vehicle to impose a force resulting from the entanglement thus slowing the rotation of the rotating parts to eventually slow and stop the vehicle in a controlled non-lethal manner.

In another embodiment the undercarriage immobilization device includes a housing, two stages of pressure generation capability, and a two-stage strap/tendril deployment scheme. This embodiment may have a series of horizontally deployed strap inflation ports oriented horizontally and extending radially from the center of the housing to just past the outermost housing wall, the housing being similar to the housing described above. These inflation ports are utilized to deploy the primary set of straps from the first stage of pressure generation. In one embodiment the activation of the first stage of pressure generation is done manually in another embodiment pressure generation is remotely activated after the undercarriage immobilization device is positioned. Upon activation a set of primary tubular straps will be deployed by inflation causing them to extend outwardly from the housing and flattening after deflation. The primary straps will rest on the ground in the immediate area of the housing extending radially from the housing. With the undercarriage immobilization device in place and the set of primary straps deployed, the next action will be dependent on a vehicle being driven over at least one of the primary straps of the set of straps projecting out from the housing of the undercarriage immobilization device. The second event in the operation of the undercarriage immobilization device will be the deployment, either manually or automatically, of the actual entanglement tendrils. When a target vehicle is driven over the housing of the immobilization device the second stage of pressure generation will be initiated. The undercarriage immobilization device is equipped with a plurality of upwardly extending barrels at various angles, each barrel housing a projectile with, in one embodiment, a frangible ball and an attached filament or tendril. These projectiles are launched using the second stage of pressure generation to cause the actuation of individual charges by a suitable projectile propellant that is triggered by gas generator pressure in the internal pressure chamber. Launching of the upwardly directed barrels can be initiated by the undercarriage immobilization device sensing the presence of the vehicle via an infrared sensor, a laser sensor, a radar or a sonar sensor, or similar proximity sensor. Alternatively, launching of the projectiles can be remotely triggered by an operator or an automatic trigger such as but not limited to a trip wire or light beam sensor tripped by the target vehicle. If an infrared or other proximity sensor mounted on the housing is used the second event activation process will be armed after the primary straps are deployed. The projectiles launched in the second event will contact the target vehicle and adhere thereto, either by an adhesive connection, a barbed hook engagement or simply because the tendrils are entangled or ensnared on the target vehicle or a moving or rotating component of the target vehicle. Once connected to the target vehicle the tendril, or possibly several tendrils, will pull secondary straps from a stored position on the housing and this strap, or possibly several straps, having greater strength then the tendrils themselves, will ensnare or entangle moving parts of the vehicle. The primary strap set and the secondary strap set may each be attached to a common central ring. With this arrangement both the primary and the secondary straps may entangle the rotating components of the vehicle. With the moving parts of the vehicle engaged first by the primary straps picked up by the target vehicle tire and wrapped around the wheel/axle assembly and/or the suspension, and then by a secondary strong strap or multiple straps that are wound around rotating assemblies of the target vehicle, the strap set will slow the target vehicle to a stop.

In addition to attaching straps to the target vehicle it is contemplated that a vehicle tracking sensor could also be attached to the vehicle. The tracking sensor, well known in the art of vehicle theft deterrence and recovery schemes, would be attached to a launched tendril, the frangible ball, or to one of the straps intended to be entangled on the vehicle.

It is an object of the invention to provide non-lethal restraint system that will restrain a moving vehicle.

It is also an object to teach an apparatus for non-lethal entanglement of a target.

It is also an object of the invention to provide a non-lethal restraint device that can be deployed from a land-based or air-borne platform.

It is another object of the invention to provide a non-lethal restraint device that is insensitive to precise placement location underneath a target vehicle.

It is also an object of the invention to provide a non-lethal restraint device that is economical to produce.

It is a further object of the invention to provide a device that contains and has the capability of launching a vehicle-tracking device from the undercarriage immobilization device.

One other object is to present an undercarriage immobilization device that is as simple as possible for a user to use including the placement of the device, arming the device and thereafter entangle a target vehicle with the device.

It is also an object of the invention to provide automatic arming and triggering systems for arming and discharging the undercarriage immobilization device so that the device can perform with minimal user intervention.

It is also an object of the invention to provide a non-lethal vehicle immobilization device that is small, compact, reloadable and reusable.

It is also an object to have a non-lethal vehicle immobilization device that can be positioned by being dropped from an aircraft or deploying the device from a moving vehicle without damage to the device.

It is also an object of the invention to have a device that can be remotely armed from a safe distance from the expected path of a target vehicle.

Another object of the invention is to provide a method of entangling a target with a tendril using relative motion of the target and the tendril to effect entanglement.

It is another object of the invention to provide a non-lethal vehicle restraint undercarriage immobilization device that can accommodate a range of targeted vehicle masses over a wide range of velocities.

It is another object of the invention to provide a non-lethal vehicle restraint device that is operative and effective for use on vehicles of various heights and drivetrain types.

It is another object to attach a tracking device to a targeted vehicle so that the vehicle can be tracked.

One advantage of this invention is that the undercarriage immobilization device does not rely on stopping the vehicle by completely ensnaring it, as it would be if a net were used as the restraining device. Rather the undercarriage immobilization device is capable of stopping a vehicle by ensnaring the rotating components beneath the vehicle and rendering them immobile.

The above and other objects may be achieved by providing non-lethal restraint system including a housing having an exterior surface and having a pressure manifold inboard of the exterior surface of the housing. The housing includes at least one barrel extending from the exterior of the housing inward to the pressure manifold and a pressure generator or stored source of pressure or compressed gas, such as, but not limited to a $CO_2$ cartridge, carried in the pressure manifold. A projectile carried in the barrel has a spool, a tendril wound on the spool and a frangible ball or other projectile connected to the tendril. It is expected that a large number of barrels will be provided in each housing.

Another way of achieving the above and other objects of the invention is through an apparatus for non-lethal ensnarement of a target having a housing with an exterior surface and a pressure manifold inboard of the exterior surface of the housing. A first pressure generator or stored source of pressure, for accomplishing a first event is carried in the housing. There is a primary tubular strap in communication with the first pressure generator and a first activation device in communication with the first pressure generator. The undercarriage immobilization apparatus will include a second pressure generator carried in the housing and a set of barrels containing projectiles in communication through a manifold to the second pressure generator. The secondary event apparatus includes a set of leader tendrils connected at the trailing ends of the leader line to a set of secondary straps. A projectile, in one embodiment, a frangible ball is attached to the leading end of the leader line. A second activation device, in communication with a second pressure generator, is used to initiate the second pressure generator.

The above and other objects may be achieved by using methods of entangling a target as set forth in this disclosure. The method may be accomplished by providing an entangling apparatus having a housing, a barrel, a pressure generator, and a projectile having a frangible ball and attached tendril. The entangling apparatus is then positioned in an expected path of a target and armed for use. When a target vehicle is being driven over the entangling apparatus, pressure generation is initiated. The pressurization will cause the launching of the projectile from the barrel of the entangling apparatus. The launched projectile will contact the target vehicle with the frangible ball or the tendril of the projectile causing entanglement of the target vehicle with the tendril of the projectile through relative motion of the target vehicle and the tendril.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of . . . " [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Figure 1:
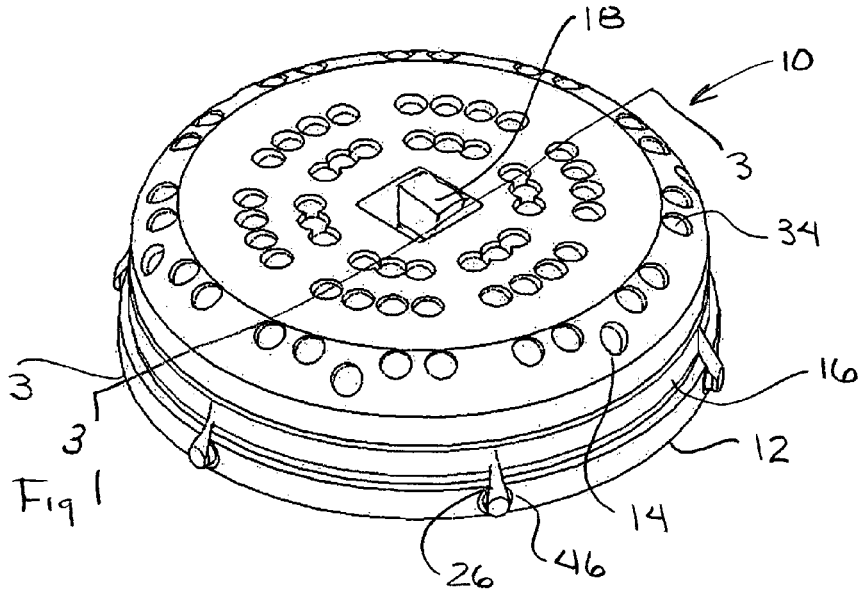
FIG. 1 depicts a view of an undercarriage immobilization device ready to be deployed.

Elements and acts depicted in the figures are illustrated for simplicity. They are presented to illustrate the invention to assist in an understanding thereof. The figures have not necessarily been rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

In one application of the invention the non-lethal restraint or undercarriage immobilization device will be positioned for use by placing the undercarriage immobilization device, either by hand in the expected pathway of a vehicle to be stopped or by dropping the undercarriage immobilization device from a moving vehicle such as an automobile or helicopter. With the undercarriage immobilization device placed on the ground it can be safely armed. Arming of the device can be performed by closing a switch on the housing or from a remote location. Once armed the undercarriage immobilization device is ready for use. As the target vehicle approaches the undercarriage immobilization device inflatable primary straps will be deployed, in one embodiment by inflating the hollow straps so that these primary straps are unfurled across the road surface or roadway. As the target vehicle drives onto or over the primary straps, the tires of the target vehicle will engage the primary straps which will connect to the tires, either through an adhesive carried on the surface of the primary straps or through hooks strategically placed on the straps, or both. At this point the primary straps are attached to the vehicle tire or other component of the moving vehicle. The primary straps will wind around the suspension and other structures on the underside of the target vehicle and pull tight or wedge between components creating a fixed hold for the strap. Meanwhile, and almost simultaneously therewith, while the target vehicle is still passing over the undercarriage immobilization device an infrared sensor, or other sensor capable of sensing the vehicle, on the undercarriage immobilization device will sense the presence of the target vehicle and initiate launching of an array of leader tendrils connected to the secondary straps. These leader tendrils will ensnare rotating components of the target vehicle and as they do the leader tendrils will draw the secondary straps carried on the base of the undercarriage immobilization device into engagement with and around rotating components of the target vehicle. These secondary straps will pull the strap package, that is the inflatable primary straps and the secondary straps, to the extent other secondary straps have not already separated from the reusable base of the device, off of the reusable base of the undercarriage immobilization device. The high elongation secondary straps, and the primary straps, to the extent they have wrapped around moving components on the underside of the target vehicle, will absorb kinetic energy from the moving target vehicle. The target vehicle will slow at a controllable rate due to the entanglement of the straps with the rotating or moving parts of the vehicle and will slow the vehicle to a stop. The slowing of the vehicle is the result of the straps being dynamic in that they will stretch causing a slower deceleration or the straps can pull tight causing a reduction in vehicle speed from friction of the straps in contact with rotating components of the vehicle. In one embodiment the entangled targeted vehicle will slow due to the kinetic energy of the vehicle is absorbed by the elongation of the straps of the strap package.

Turning first to FIG. 1, the undercarriage immobilization device is shown generally as item 10. The device includes a housing 12 with numerous barrels, such as 14, a strap package 16 and a proximity detector and actuation device and other necessary control circuitry package 18.

Figure 2:
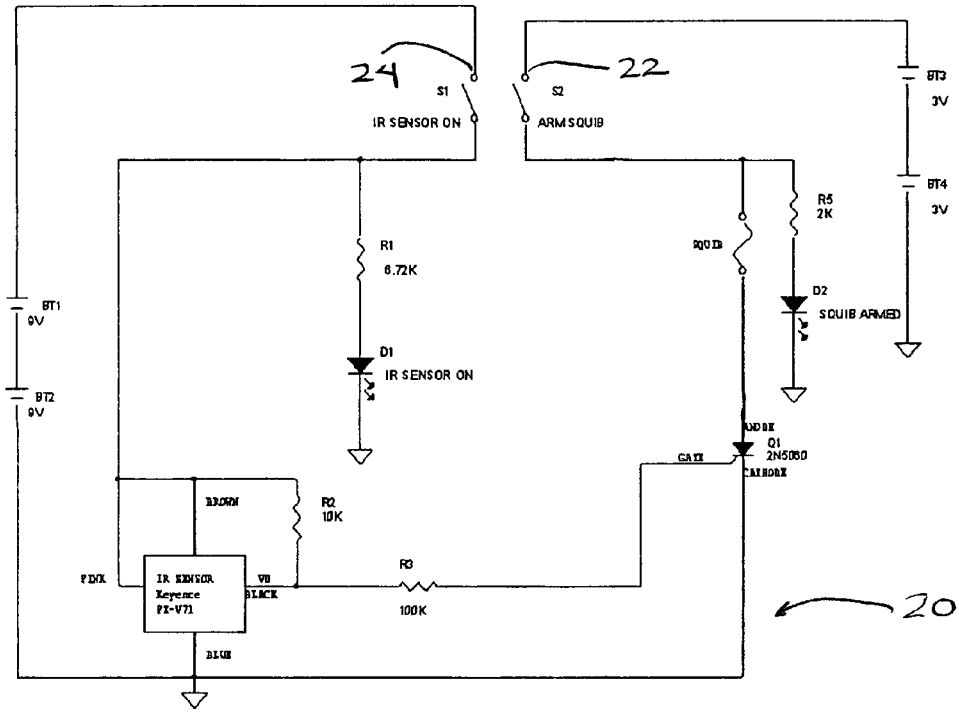
FIG. 2 is a schematic of the actuation circuit used to control the undercarriage immobilization device shown in FIG. 1.

FIG. 2 is an electrical schematic of a triggering circuit, shown generally as item 20. This circuit includes a switch 22 to arm the undercarriage immobilization device and a remote signal responsive switch 24. In one embodiment switch 24 is activated after the device is armed and after, or coincidentally with, the first event, the deployment of primary straps of the device, has been or is accomplished. The switch 22 can be closed manually or remotely by an operator controlling the device. In addition to the circuit shown it is contemplated that this circuit can be modified to accomplish the arming, activation, and launching of projectiles from the device. For instance after sensing a vehicle the circuit will send a signal to the second pressure generator to generate pressure to launch projectiles (either directly with this pressure or through triggering a local pressure generator associated with each of the projectiles). It may be advantageous to incorporate a processor into the circuit so that delay after sensing a vehicle can be calculated and the projectiles deployed at a particular delay depending on vehicle dynamics and/or type.

Figure 3:
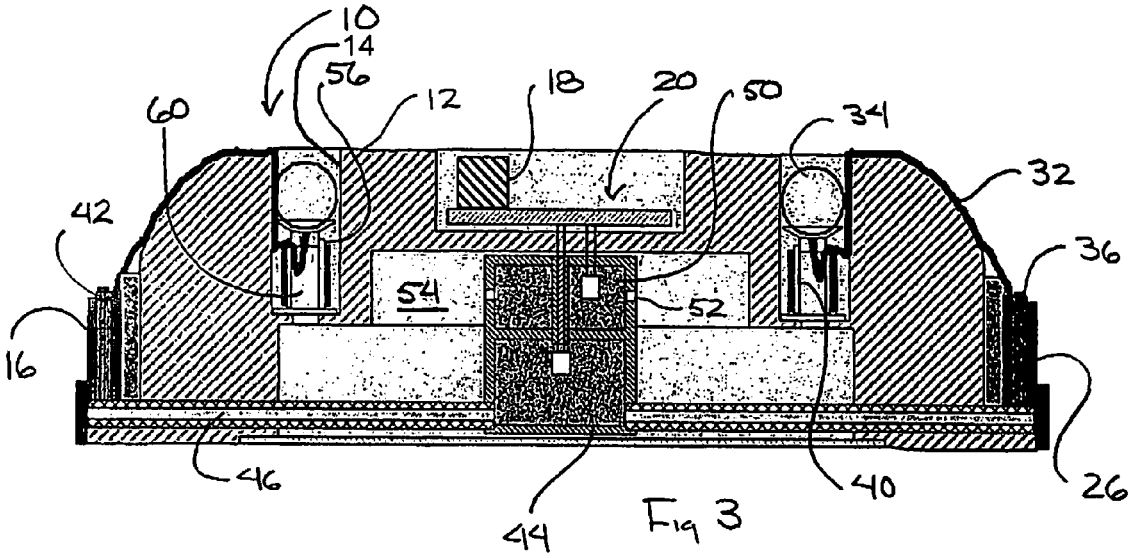
FIG. 3 is a cross-sectional view through plane 3-3 of FIG. 1.

FIG. 3 is a cross-sectioned view of the immobilization device taken through plane 3-3 of FIG. 1. This pictorial representation of the device shows one embodiment of the invention. The housing 12 will contain a proximity and actuation device package 18 that is in communication with the triggering circuit board 20. The IR sensor component of the board is shown as a schematic in FIG. 2. A primary gas generator chamber 44 is electrically connected with the triggering circuit 20. A set of ports, such as 46, extend from the primary gas generator chamber 44 to input ends of inflatable primary straps 26. In one embodiment upon actuation and the discharge of gas from the primary gas generator 44 the inflatable straps 26 will be deployed to the position shown in FIG. 4. In another embodiment the discharge of gas from the primary gas generator will trigger a local pressure generating or pressure supplying device in communication with each of the inflatable straps to supply inflation and deployment pressure to the inflatable primary straps.

In FIG. 3 a secondary gas generator chamber 50 is shown. This chamber 50 has ports such as the ports 52 that connect the chamber 50 to a manifold 54. The manifold 54 provides communication to a plurality of launch chambers 60, each associated with a projectile which includes a frangible ball 34 and spool assemble 40 on which leader tendrils are wound. The leader tendrils 32 are attached at one end to the frangible ball 34 and has the tail end of the leader line attached to a secondary flat strap 36. The projectiles are supported in the spool tubes 56. Both the secondary straps 36 and the primary straps are attached to a central ring 42.

The projectiles shown in FIG. 3 may be directly connected to the manifold 54 to be launched by gas pressure generated by the secondary gas generator 50. In another embodiment the pressure in the manifold 54 from the secondary gas generator 50 will be used to actuate a launch device. The launch device could be an explosive charge such as an explosive cartridge or a compressed gas device, either of which, when actuated, is capable of launching individual projectiles including the frangible balls 34 and the attached leader tendrils 32.

The flat secondary straps 36, which are attached to one or more of the leader tendrils 32, are expected to be too heavy, in most configurations, to be pulled by the projectile launch itself. Therefore the leader tendrils 32 will be long enough, on the order of greater than a foot long and not much longer that about fifteen feet long, to entangle with the rotating components of the target vehicle and once entangled the leader tendrils will drag the flat secondary straps into entanglement with the rotating elements of the target.

Figure 4:
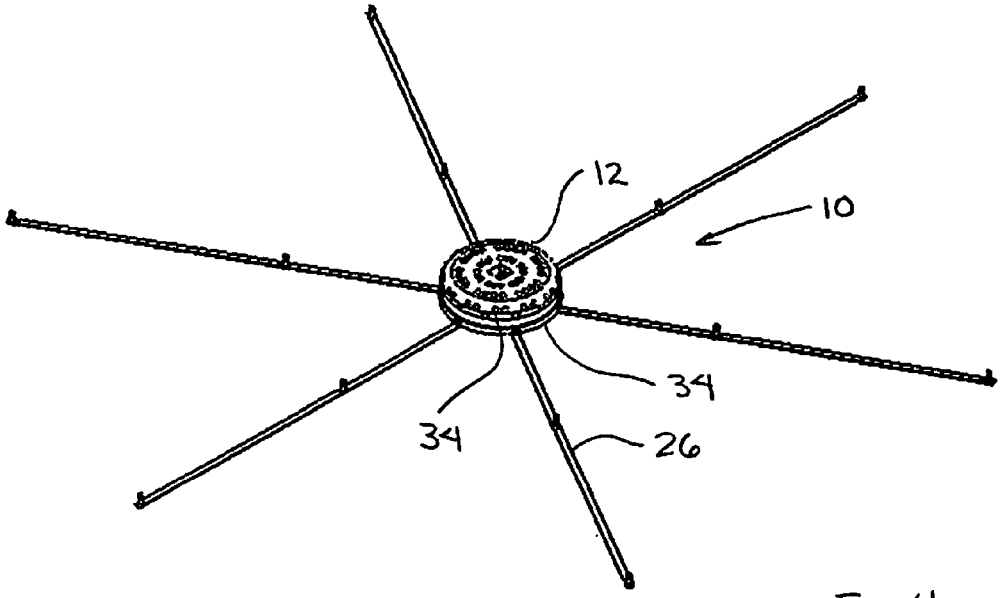
FIG. 4 depicts the undercarriage immobilization device after a first event activation.
Figure 5:
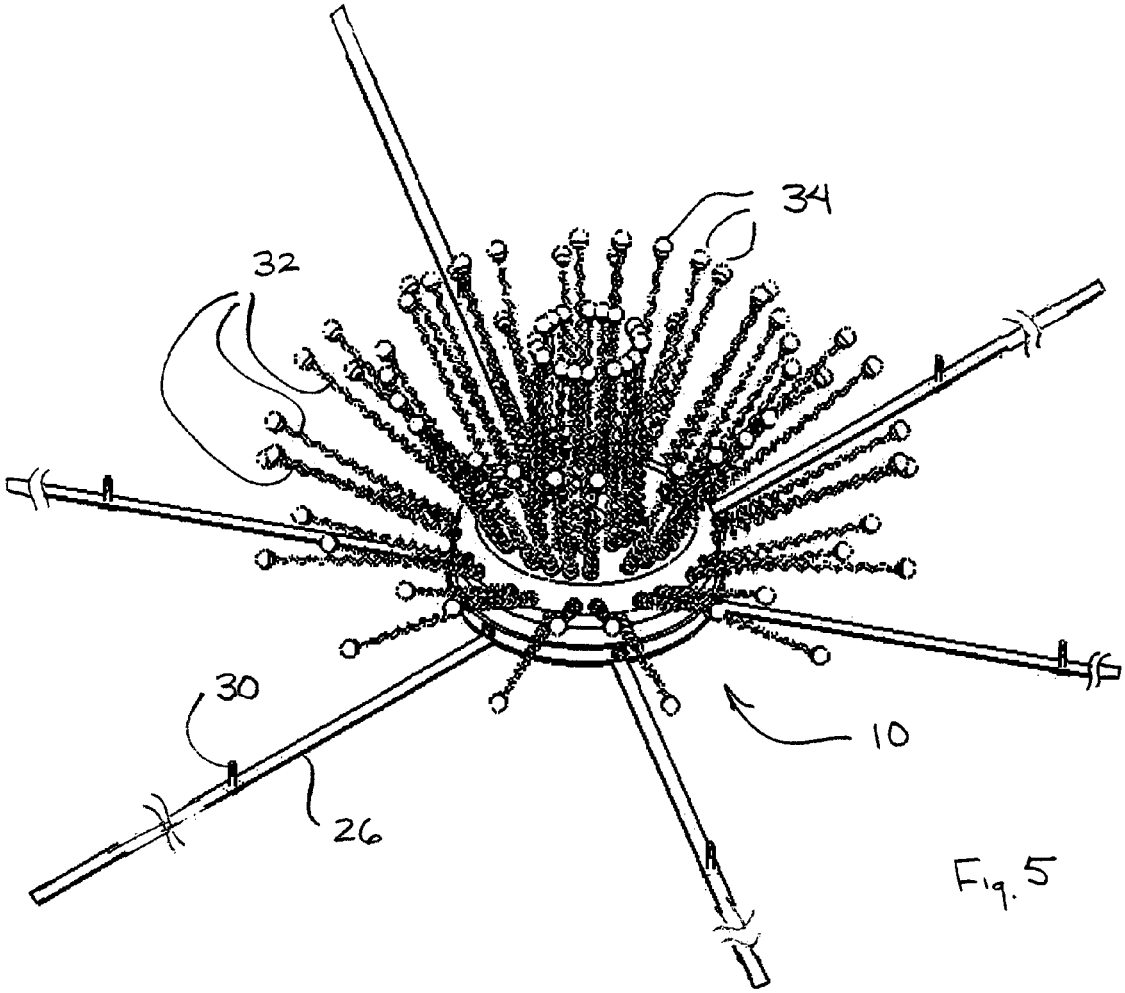
FIG. 5 depicts the undercarriage immobilization device partway through a second event activation.

FIG. 4 shows the undercarriage immobilization device generally 10 with a plurality of inflatable primary straps such as primary straps 26 deployed in a wide area around the housing 12. These primary straps 26 are deployed after placement of the undercarriage immobilization device in a desired location. The straps may be tubular structures of high strength fabric, with or without an internal impervious, elongated bladder, that are wrapped in an overlapping fashion around the perimeter of the undercarriage immobilization device in the center vertical section of the device. These primary straps 26, in one embodiment there will be six straps per undercarriage immobilization device, will unfurl when they are inflated using gas generated from the primary gas chamber 50 of FIG. 3. The primary straps 26 will form a grid of straps as shown in FIGS. 4 and 5. These straps 26, will be fitted with upwardly extending barbs, hooks, attachment devices, including but not limited to adhesive patches, that can quickly attach to a rolling vehicle tire. The barb embodiment is shown as items 30 in FIG. 5. Each of these adhering devices is capable of attaching the primary straps 26 to a tire of a vehicle being driven over the deployed straps. To begin the restraining action of a target vehicle these primary straps 26 will attach to the vehicle's tire by connection through the barbs or adhesives, and rotate with the tire for at least a portion of a tire revolution and thus bring the primary strap that is stuck to the tire up into undercarriage of the vehicle.

Figure 8:
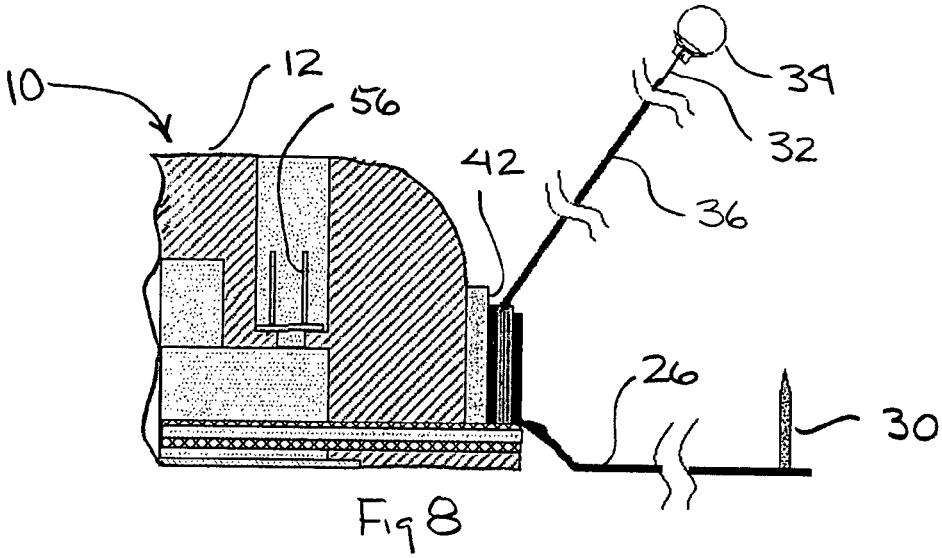
FIG. 8 is a pictorial representation of a portion of the undercarriage immobilization device picturing a second event deployment in progress.

FIG. 5 shows the device with the primary straps 26 extended. It also shows a plurality of leader tendrils such as 32 deployed from the housing 12 of the device generally 10. Each of these leader tendrils 32 is attached to an adhesive filled frangible ball 34 that was launched from the housing. The leader tendrils 32 are attached to the flat secondary straps 36 which are used to entangle the target vehicle. As shown in FIG. 8 the leader line 32, having the adhesive frangible ball attached at one end thereof, is also attached, at a second end, to the strap 36. In one embodiment there will be several leader tendrils such as 32 attached to a single strap such as 36.

Figure 6:
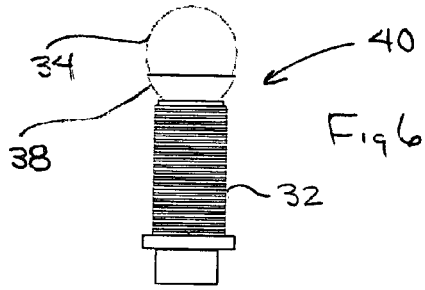
FIG. 6 is a pictorial representation of a projectile of the type used in the undercarriage immobilization device.

FIG. 6 is a presentation of the projectile generally 40. The projectile 40 includes a frangible ball 34 that is attached, in one embodiment using a mounting cup 38, to the leader line 32 wound on a spool. When the projectile is launched the frangible ball, and the mounting cup if used, will pull the leader line from the spool. The frangible ball may encapsulate an adhesive or it may encapsulate a barb or hook element, or both, to assist entangling a rotary component of the target vehicle.

Figure 7:
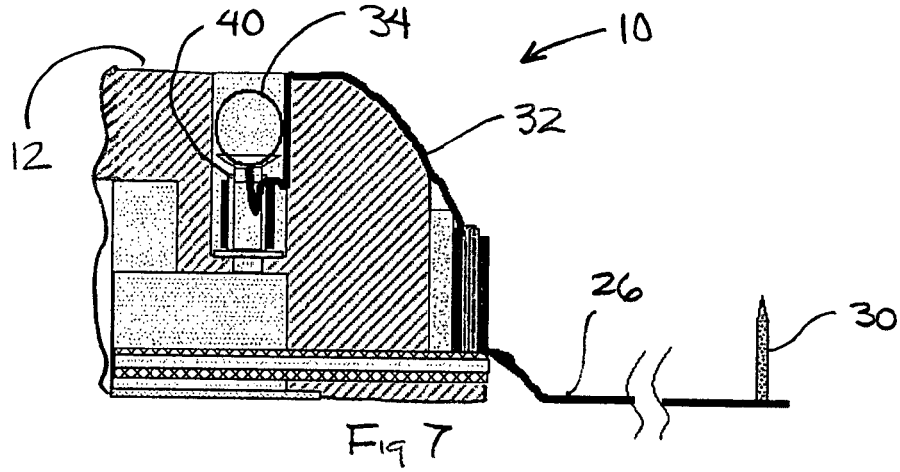
FIG. 7 is a pictorial representation of a portion of the undercarriage immobilization device picturing a post first event occurrence.

FIG. 7 shows a cross section of a portion of the undercarriage immobilization device 10, after a first event completion, which shows a primary strap 26 extending outwardly from the housing 12 of the device. A barb 30 is shown projecting from the top of the primary strap 26.

FIG. 8 pictorially shows a progressing deployment after the second event activation of the immobilization device 10. The frangible ball 34 and the attached leader line 32 are shown attached to a secondary strap 36. This secondary strap will not be dragged from the housing only by the launch of the projectile but will be dragged off the housing by the leader line after the leader line has made an entangling or adhesive connection with a target vehicle.

Figure 9:
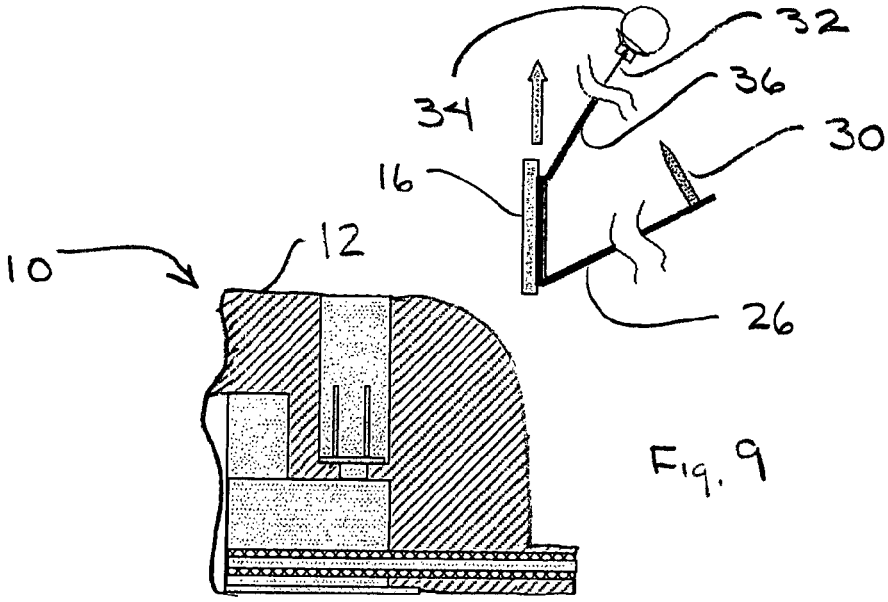
FIG. 9 is a pictorial representation of the deployment of primary and secondary straps of the undercarriage immobilization device.

FIG. 9 shows the immobilization device with the primary straps such as 26 and the secondary straps, for instance 36, (each set of straps attached to the central ring strap 42) post engagement with the target vehicle, leaving their stored location on the housing 12. The inflatable primary straps 26 were launched from the housing generally 10 using a compressed gas or other means of propellant that will inflate and unfurl the primary straps. These primary straps are shown in a ready to be deployed position in FIGS. 1 and 3 and in a deployed position in FIGS. 4, 5 and other figures. The secondary straps 36 are deployed through their attachment to the leader tendrils 32. The leader tendrils 32 having been launched with the frangible balls of the projectile and spool assembly generally 40 in FIGS. 3, 6 and other figures. As shown in FIGS. 3 and 9, the leader tendrils such as 32, are attached to secondary straps 36. Several leader tendrils may be attached to each strap or a single leader line may be attached to a single strap. The secondary straps 36 are wound around the housing under the primary straps and attached to the central ring 42 and will be unwound as they are pulled by the leader tendrils and rotating structures of the vehicle that the leader tendrils have attached to.

The primary straps 26 and the secondary straps 36 will entangle themselves on a target vehicle as the target vehicle moves over the undercarriage immobilization device. First the primary straps 26 will attach to the tires as the tires drive over the strips and get attached by the use of barbs, such as 30, or adhesive material located on the surface of the inflatable primary straps. Next the secondary straps 36, attached to the lead lines 32, are launched, within a very short time period of the primary straps being picked up by the tires of the vehicle, the secondary straps will start to entangle on the underside of the vehicle. The adhesive of the frangible balls, assisted by barbs if the frangible balls also included barbs, may stick to the underside of the vehicle or the vehicle tires and the straps attached to the leader tendrils will, when the leader tendrils are attached to the vehicle, entangle with the vehicle. The entangled primary straps and the entangled secondary straps, or each or any of them, will be stripped off the housing of immobilization device as shown in FIG. 10. The straps 26 and 36 are sewn or otherwise attached to a central ring 42 so that the strap package will be removed as a set or package of straps from the housing and the strap package will remain with the entangled target vehicle. In this way the strap package will continue to wrap itself around moving parts of the target vehicle while the housing will be left behind to be collected and reloaded for subsequent use.

The deployment of the primary and secondary straps is accomplished in two phases or events using two separate deployment propellants.

The first event is the deployment of the inflatable primary straps after the device is positioned for use. For the deployment of the primary straps in event one a primary gas generator can be used. The gas generator will be activated by an operator from a remote location through use of an actuation device that is part of the proximity detector and actuation device package 18. By rapidly filling the tubular primary straps with gas generated in the primary gas generator, or gas released from a storage device that is actuated by gas generated in the primary gas generator, the inflatable primary straps will unroll from their stored position on the housing shown in FIG. 1 to the deployed position as shown in FIG. 4 and the other figures.

Event two in the use of the non-lethal restraint device is the deployment of the secondary straps and leader tendrils that will ensnare the undercarriage of a target vehicle. This second event can be initiated as the primary straps are picked up by the vehicle or, alternatively, when the primary straps are not picked up by the vehicle tires, but when the secondary straps are deployed based on a signal from a proximity detector or deployed by an operator with a remote actuator.

The primary straps may have barbs or adhesives that will stick to a vehicle tire causing the primary straps be captured and wound up on the axle or wheel and axle assembly of the targeted tire. As soon as at least one of the primary straps is attached to a tire, or at any time the target vehicle is over the immobilization device, a signal will be sent from an activation device. As stated above, the activation device for activating the gas generator in event two can be an automatic device sensing the presence of the target vehicle such as, but not limited to a laser based, sonar based or other proximity detector, or by a human equipped with a remote activator to send a signal to the housing to activate the gas generator or by interaction between the primary straps and the device. Any one of these methods can be used to activate an activator of the gas generator to activate and launch the spool assemblies including the adhesive frangible balls and the lead lines carried in the housing.

The inventor has found that a gas generator of the type used in automotive airbag deployment systems that has been integrated into the device provides a good source of pressurized gas for deploying the primary and secondary straps.

FIG. 5 shows the deployment of the frangible balls and the attached leader tendrils being launched out of the housing. This is also shown in FIG. 7.

In operation the device will be placed, dropped or tossed into a location where a target vehicle is expected to pass over the undercarriage immobilization device. The device will be armed by a person using a radio frequency signal sent from a remote location or by having a user tripping a mechanical switch on the device itself. As a target vehicle approaches the undercarriage immobilization device the primary straps will be deployed by an operator sending a signal to the device to activate the primary gas chamber to inflate the primary tubular straps. The target vehicle will drive over the primary straps and the barbs or adhesive on the straps will stick the primary straps or at least one strap to a vehicle tire. These primary straps will wrap around the wheel, axle or suspension components of the target vehicle. As the target vehicle passes over the undercarriage immobilization device an infrared sensor, or alternatively a laser or sonar based sensing device, will initiate the launching of the secondary straps which are attached to the lead lines and frangible balls attached to the leader tendrils. These leader tendrils, in cooperation with the frangible balls, or just as the leader tendrils themselves will wrap around rotating or moving elements on the underside of the target vehicle. The leader tendrils will draw the secondary straps into the rotating components of the vehicle. The primary and secondary straps will be separated from the device housing as the leader tendrils and the primary and secondary straps are entangled in the rotating components of the vehicle. This will allow the housing to avoid being drawn into the rotating components of the vehicle and therefore allow the housing to be reloaded and reused.

Once in contact with the rotating components of the vehicle the primary and secondary straps, these straps being high elongation straps that can absorb significant kinetic energy, will cause the vehicle to slow controllably until the vehicle comes to stop.

The apparatus presented herein is, in summary, an apparatus that provides a non-lethal restraint including a housing having an exterior surface and a pressure manifold inboard of the exterior surface of the housing. There is a barrel in the apparatus that extends from the exterior of the housing to the pressure manifold. The apparatus also includes a pressure source carried in the pressure manifold. A projectile is carried in the barrel and a tendril is connected to the projectile.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

What is claimed is:

1. An apparatus for ensnaring a component of a terrestrial vehicle, comprising:

a housing having at least one barrel;

a pressure generator disposed in the housing, the barrel operably coupled with the pressure generator;

a projectile carried in the barrel and having a tendril; and a strap operably coupled to the tendril, wherein the strap is coupled to the housing;

wherein activation of the pressure generator in the vicinity of a moving terrestrial vehicle causes the projectile to adhere to the vehicle, thereby causing the strap to dislodge from a stored position and entangle the component of the terrestrial vehicle, and further wherein the entanglement of the strap with the component of the moving terrestrial vehicle causes the strap to separate from the housing.

2. The apparatus in accordance with claim 1 comprising a switch in communication with the pressure generator.

3. The apparatus in accordance with claim 1 wherein the projectile comprises a frangible ball connected to the tendril, which in turn is connected to the strap.

4. The apparatus in accordance with claim 2 wherein the barrel comprises a launch chamber that includes a source of compressed gas.

5. The apparatus in accordance with claim 2, further comprising a proximity sensor connected to the switch.

6. An apparatus for non-lethal ensnarement of a target comprising:

a housing having an exterior surface and a pressure manifold inboard of the exterior surface of the housing;

a first pressure generator disposed in the housing;

a primary tubular strap operably coupled to be inflated by the first pressure generator;

a first activation device operably coupled with the first pressure generator;

a second pressure generator disposed in the housing;

a barrel extending from the exterior surface of the housing, the barrel operably coupled with the pressure manifold;

a projectile disposed in the barrel, the projectile having a frangible ball and a tendril, the barrel and pressure manifold being operably coupled with the second pressure generator; and a second activation device operably coupled with the second pressure generator.

7. The apparatus in accordance with claim 6 wherein the first activation device comprises a remote activation device.

8. The apparatus in accordance with claim 7 wherein the primary tubular strap comprises an elongated strap having a barb attached thereto and extending upwardly from the primary tubular strap whereby the primary tubular strap is extended from the housing upon activation of the first pressure generator to expose the barb attached to the strap.

9. The apparatus in accordance with claim 8 comprising a proximity detector operably coupled with the second activation device, whereby the second activation device will activate the second pressure generator in response to activation of the second activation device.

10. The apparatus in accordance with claim 9 comprising a secondary strap operably coupled to a leader line.

11. The apparatus in accordance with claim 10 wherein the secondary strap is one of a plurality of secondary straps disposed on the housing, the leader line is one of a plurality of tendrils and each one of the secondary straps is operably coupled to one or more than one of the tendrils.

12. The apparatus in accordance with claim 6 comprising a launch chamber operably coupling the barrel to the pressure manifold.

13. An apparatus for decelerating movement of a terrestrial vehicle, comprising:

a plurality of projectiles configured to be launched from a housing toward a rotating element of the terrestrial vehicle; and at least one strap coupled to at least one of the projectiles and the housing, the strap being configured to wrap around the rotating element;

wherein the strap constricts on the rotating element to inhibit rotation of the rotating element, and further wherein the constriction of the strap on the rotating element causes the strap to be stripped from the housing.

14. The apparatus of claim 13, further comprising:

a plurality of tendrils, each of the tendrils couples an individual projectile to the strap;

wherein at least one of the tendrils wraps around the rotating element to cause the strap to wrap around the rotating element.

15. The apparatus of claim 13 wherein individual projectiles comprise at least one of a weight, a ball, a barb, and an adhesive.

16. The apparatus of claim 13, further comprising a plurality of straps.

17. The apparatus of claim 13, further comprising:

a base including a launching device;

wherein the launching device deploys the projectiles from a proximal position with respect to the base toward the rotating element.

18. The apparatus of claim 17 wherein the launching device comprises a pyrotechnical device configured to produce an expanding gas.

19. The apparatus of claim 18 wherein the base comprises a manifold configured to distribute the expanding gas to each of the projectiles.

* * * * *